US008610515B2

(12) United States Patent
Lan et al.

(10) Patent No.: US 8,610,515 B2
(45) Date of Patent: Dec. 17, 2013

(54) TRUE TIME DELAY CIRCUITS INCLUDING ARCHIMEDEAN SPIRAL DELAY LINES

(75) Inventors: Xing Lan, Huntington Beach, CA (US); Mark Kintis, Manhattan Beach, CA (US); Chad Hansen, Torrance, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 379 days.

(21) Appl. No.: 13/103,634

(22) Filed: May 9, 2011

(65) Prior Publication Data

US 2012/0286899 A1 Nov. 15, 2012

(51) Int. Cl.
*H01P 1/18* (2006.01)

(52) U.S. Cl.
USPC ..... 333/161; 333/164

(58) Field of Classification Search
USPC ..... 333/161, 164, 156, 140; 257/531
See application file for complete search history.

(56) References Cited

U.S. PATENT DOCUMENTS

| | | | | |
|---|---|---|---|---|
| 2,832,935 | A * | 4/1958 | Tank | 333/140 |
| 3,017,633 | A | 1/1962 | Marston et al. | |
| 3,135,960 | A | 6/1964 | Kaiser, Jr. | |
| 3,585,535 | A * | 6/1971 | Senf | 333/161 |
| 4,614,922 | A | 9/1986 | Bauman | |
| 4,641,114 | A * | 2/1987 | Person | 333/161 |
| 4,749,971 | A | 6/1988 | Solie | |
| 5,164,692 | A * | 11/1992 | Gertel et al. | 333/238 |
| 5,619,218 | A | 4/1997 | Salvail et al. | |
| 5,701,372 | A | 12/1997 | Magel et al. | |
| 5,815,122 | A | 9/1998 | Nurnberger et al. | |
| 5,936,594 | A | 8/1999 | Yu et al. | |
| 5,974,335 | A | 10/1999 | Talisa | |
| 6,101,705 | A | 8/2000 | Wolfson et al. | |
| 6,320,480 | B1 | 11/2001 | Kintis et al. | |
| 6,430,805 | B1 | 8/2002 | Ekmekji et al. | |
| 6,781,560 | B2 | 8/2004 | Goldstein | |
| 6,897,829 | B2 | 5/2005 | Oliver et al. | |
| 7,162,106 | B2 | 1/2007 | Upton | |
| 7,251,395 | B2 | 7/2007 | Upton | |
| 7,525,509 | B1 | 4/2009 | Robinson | |
| 7,835,157 | B2 | 11/2010 | Tilmans et al. | |
| 2003/0128082 | A1 | 7/2003 | Mazzochette | |

(Continued)

OTHER PUBLICATIONS

Wilden, H. "A radar frontend with time steered array antenna for PAMIR" Proceedings of the 37th European Microwave Confernece, Oct. 2007, Munich Germany, pp. 1481-1484.

(Continued)

*Primary Examiner* — Benny Lee
(74) *Attorney, Agent, or Firm* — John A. Miller; Miller IP Group, PLC

(57) ABSTRACT

A time delay circuit including at least one spiral delay line formed on a top surface of a first substrate. In one embodiment, the delay line is defined by two concentric spiral delay line sections. Vias extend through the substrate between the delay line sections to reduce cross-talk therebetween. In another embodiment, the delay circuit includes a second substrate spaced from the first substrate, where a spiral delay line is formed on a top surface of the second substrate. A planar metal layer is provided on a backside surface of the first substrate and a conductive element extends through an opening in the metal layer and is coupled to the spiral delay lines, where the planar member provides magnetic isolation between the delay lines. In yet another embodiment, a multi-bit switched circuit can be provided on one of the substrates and be electrically connected to the delay line.

20 Claims, 3 Drawing Sheets

(56) References Cited

U.S. PATENT DOCUMENTS

| | | | | |
|---|---|---|---|---|
| 2005/0104158 | A1* | 5/2005 | Bhattacharjee et al. | 257/531 |
| 2007/0001794 | A1 | 1/2007 | Alford et al. | |
| 2010/0066624 | A1 | 3/2010 | Masuda et al. | |
| 2010/0258931 | A1 | 10/2010 | Yoshida | |
| 2011/0043328 | A1 | 2/2011 | Bassali | |

OTHER PUBLICATIONS

Rahman et al. "Broadband Absorbing Material Design and Optimization of Cavity-backed, Two-arm Archimedean Spiral Antennas", International Symposium Antennas and Propagation and CNC-USNC/URSI Radio Science Meting IEEE Jul. 11-17, 2010 4 pp. Toronto, ON, Canada.

Popovic Zoya, "Micro-coaxial Micro-fabricated Feeds for Phased Array Antennas", 978-1-4244-5128-9/10 IEEE 2010.

Mruk et al. "Directly fed millimetre-wave two-arm spiral antenna", Electronics Letters Nov. 25, 2010 vol. 46 No. 24.

Abielmona et al. "Compressive Receiver Using a CRLH-Based Dispersive Delay Line for Analog Signal Processing", IEEE Transactions on Microwave Theroy and Techniques, vol. 57 No. 11 Nov. 2009.

Schreider et al. "Broadband Archimedean spiral antenna above a loaded electromagnetic band gap substrate", IET Microw Antennas Propag. vol. 1, No. 1 Feb. 2007 pp. 212-216.

Wang et al. "Wide-Band Superconducting Coplanar Delay Lines", IEEE Transactions on Microwave Theory and Techniques vol. 53, No. 7, Jul. 2005 pp. 2348-2354.

Hacker et al. "A Ka-Band 3-bit RF MEMS True Time-Delay Network" IEEE Transactions on Microwave Theroy and Techniques vol. 51, No. 1 Jan. 2003 pp. 305-308.

Kozyrev et al. "Electrically Controlled Ferroelectirc Delay Line", 13th Int. Crimean Conference Microwave & Telecommunication Technology (CriMiCo 2003) Sep. 8-12 Sevastopol, Crimea, Ukraine ISBN 966-7968-26-X IEEE Catalog No. 03EX697.

Wu et al. "Flat Spiral Delay Line Design with Minimum Crosstalk Penalty", IEEE Transactions on Components, Packaging and Manufacturing Technology—Part B. vol. 19, No. 2, May 1996 pp. 397-402.

Talisa et al. "High-Temperature Superconducting Wide Band Delay Lines", IEEE Transactions on Applied Superconductivity, vol. 5, No. 2, Jun. 1995 pp. 2291-2294.

Manuscript this work was sponsored by the Department of the Army "A Note on the Dielectric-Filled Waveguide as a Delay Line for Pulse Compression", IEEE Transactions on Microwave Theory and Techniques Jun. 1971.

Kaiser Julius A. "The Archimedean Two-Wire Spiral Antenna", IRE Transactions on Antennas and Propagation May 1960 pp. 312-323.

* cited by examiner

TRUE TIME DELAY CIRCUITS INCLUDING ARCHIMEDEAN SPIRAL DELAY LINES

BACKGROUND

1. Field of the Invention

This invention relates generally to a true time delay (TTD) line and, more particularly, to a TTD line circuit including one or more Archimedean spiral delay lines and components for providing electric and/or magnetic isolation between the delay lines.

2. Discussion of the Related Art

TTD lines are electrical devices that delay an electrical signal, such as an RF signal, for a defined period of time. Standard TTD technology employs digitally switched transmission line sections where weight, loss and cost increase rapidly with increased operational frequency and/or phase tuning resolution.

TTD lines have application for many electrical circuits and systems, especially wideband systems. For example, TTD lines have application for wideband pulse electronic systems, where the TTD line provides an invariance of a time delay with frequency or a linear phase progression with frequency. In this application, the TTD line allows for a wide instantaneous signal bandwidth with virtually no signal distortion, such as pulse broadening during pulsed operation.

TTD lines also have application in wideband phased array antenna systems. These types of phased arrays provide beam steering where the direction of the antenna beam can be changed or scanned for the desired application. As the beam radiation pattern changes, the phase of the received signals at the node from different antenna elements also changes, which needs to be corrected. Phase shifters can be provided for each antenna element for this purpose. The frequency and bandwidth of a conventional phased antenna array is altered or limited by the bandwidth of the array elements, where limitations are caused by the use of the phase shifters to scan the antenna beam. TTD lines can be employed in the place of phase shifters to provide a delay in the transmitted and received signals to control the phase. The use of TTD lines potentially eliminates the bandwidth restriction by providing a theoretically frequency independent time delay on each antenna element channel of the array.

The most distinct advantage of a TTD based phased array is the elimination of the beam squint effect. Compared to those phase shifter based phased arrays, TTD based phased arrays can simultaneously operate at various frequencies over a very wide bandwidth without losing precision of antenna directionality across the entire band.

There are a number of techniques and designs in the art for providing TTD lines. For example, high temperature superconductor delay line structures have been disclosed. One particular structure of this type includes two substrates having thin film strips on opposing sides that are in contact with each other to implement a single strip-line circuit, which provides an air gap between the substrates. However, this type of design provides a narrow RF line width that increases overall signal loss. If a wider strip line is used, then extra long tapered transformer sections are required to interface with 50 ohm systems, which causes extra size and loss that complicate the design. Further, there are related manufacturing issues in that only periodic contacts exist on the RF traces. Also, accumulative cross-talk and forward/backward coupling may be a problem. The design is also typically expensive to deploy and difficult to integrate with other components and systems.

Coaxial delay lines are also known in the art and have long been used in electronic systems to delay, filter or calibrate signals. Coaxial delay lines can be provided in many different sizes and formed into countless configurations. Certain front-end designs can improve cost, size, configuration and overall electrical performance of not just the delay line, but the overall system. However, coaxial delay lines are typically not suitable for planar integration, are difficult to mechanically form and have a velocity factor that is higher than most commercially available coaxial cables.

Other known TTD lines include delay lines having a constant resistance, varactor non-linear transmission line (NLTL) tunable delay lines, ferro-electric substrate tunable delay lines, dielectric filled waveguide delay lines, surface acoustic wave (SAW) delay lines, air line inside a PCB three-dimensional coaxial structure delay line, micro-electro-mechanical system (MEMS) tunable transmission delay lines, meta material structure synthesized transmission delay lines, photonics delay lines, resonator structure delay lines, and digital time delay lines.

However, each of these TTD line designs suffers one or more drawbacks that make it at least somewhat undesirable for wideband applications, such as wideband phased array antenna systems. For example, delay lines having a constant resistance are typically limited to lower microwave frequency bands and are very lossy. Varactor NLTL tunable delay lines have issues with the varactors, a small time delay range, and are difficult to tune because of being continuous in a digital command world. Ferro-electric substrate tunable delay lines have problems with linearity, require very high voltages, have variable impediments and return losses, and are difficult for providing as much delay as desired. Dielectric filled waveguide delay lines are typically very heavy and bulky for practical applications. SAW delay lines are typically difficult to implement at high frequencies, provide too much signal loss and are difficult to manufacture. Air line coaxial structure delay lines are typically heavy and bulky to be practical. MEMs tunable transmission lines typically have too small of a delay time, are often unreliable and require high voltages. Meta material structure synthesized transmission lines typically are very narrow band. Photonics delay lines typically require too much power and have significant RF losses. Resonant structure delay lines are typically difficult to provide both wide bandwidth and high delay at the same time. Digital time delay lines typically have high power consumption.

What is needed is a TTD line that provides all of the desired qualities for wideband applications, such as significant delay, ease of manufacture for monolithic integration, ease for multi-bit delay implementation, low weight, low cross-talk, forward/backward coupling, low radiation level, small size, ultra-wide bandwidth, low losses, low cost, etc.

DETAILED DESCRIPTION OF THE EMBODIMENTS

The following discussion of the embodiments of the invention directed to TTD lines is merely exemplary in nature, and is in no way intended to limit the invention or its applications or uses.

Figure 1:
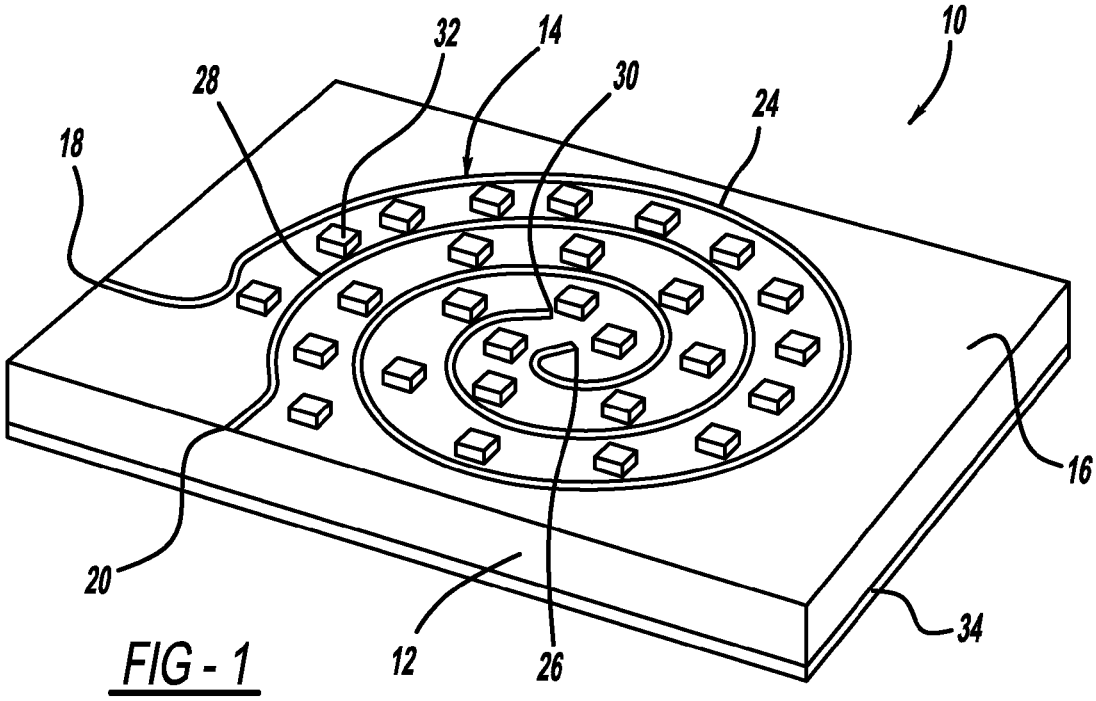
FIG. 1 is a perspective view of a TTD line circuit fabricated on a substrate.

FIG. 1 is a perspective view of a TTD line millimeter wave integrated circuit (MMIC) 10 including a substrate 12, where the substrate 12 is typically a semiconductor substrate made of a semiconductor material suitable for a particular application. The material of the substrate 12, the thickness of the substrate 12, etc. would be selected for the particular application. A metalized microstrip line 14 is deposited and formed on a top surface 16 of the substrate 12 in the shape of an Archimedean spiral. The width of the microstrip line 14, the material of the microstrip line 14, the length of the microstrip line 14, the spacing between the microstrip line 14, etc., would be application specific and could be simulated to provide the optimal performance for the particular application. Alternately, it may be possible to form the microstrip line 14 as a slot line, stripline or any other suitable type of transmission line. The microstrip line 14 includes two outer ports 18 and 20 at opposite ends of the line 14, where one of the ports 18 or 20 is an input port and the other of the ports 18 or 20 is an output port. A signal provided to the input port 18 or 20 propagates along the line 14 to the output port 20 or 18 and is delayed by the propagation time through the line 14. Thus, the length of the line 14 defines the delay.

The microstrip line 14 is separated into a first line section 24 having an inner port 26 at a center location of the line 14 opposite to the port 18 and a second line section 28 having an inner port 30 opposite to the port 20 and adjacent to the port 26. The two line sections 24 and 28 are concentric with each other. Circuit components, such as other time delay sections, can be coupled to the ports 26 and 30 at the center of the microstrip line 14 for reasons that would be well understood by those skilled in the art. Alternately, the ports 26 and 30 can be connected together so that the line 14 is continuous.

Because the line sections 24 and 28 are basically parallel to each other as they wind to the center of the line 14, there is signal cross-talk between the line sections 24 and 28 that causes signal loss. In other words, the signal being delayed and propagating down the line sections 24 and 28 are electromagnetically coupled between the line sections 24 and 28 so that signal intensity is lost as a result of the signal transferring from one of the line sections 24 or 28 to the other line section 24 or 28. In order to electrically isolate the line sections 24 and 28 from each other and reduce the cross-talk, the circuit 10 includes a plurality of metal vias 32 provided between the line sections 24 and 28 that extend through the substrate 12. In this embodiment, the vias 32 are ground vias that are electrically routed to a ground plane 34 deposited and formed on a backside of the substrate 12. The metal in the vias 32 disrupts the signal electro-magnetic coupling between the line sections 24 and 28 that reduces or prevents cross-talk therebetween. These vias also help to eliminate possible cavity resonances. The number of the vias 32, the size of the vias 32, the spacing between the vias 32, the material of the vias 32, etc., would typically be different for different circuits where the various parameters for the vias 32 could be designed to provide optimal performance.

Figure 2:
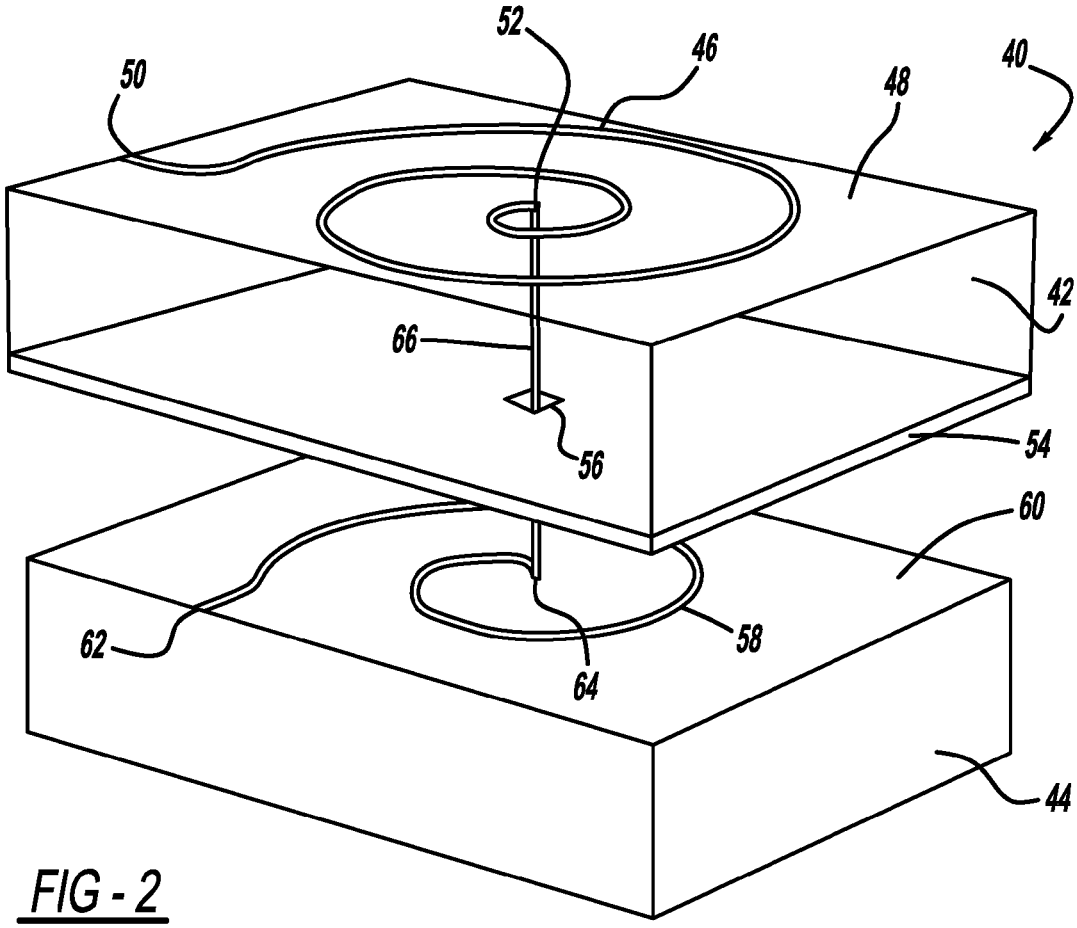
FIG. 2 is a perspective view of a TTD line circuit including a first Archimedean spiral on one substrate and a second Archimedean spiral on an adjacent substrate.

FIG. 2 is a perspective view of a TTD line MMIC 40 including a top semiconductor substrate 42 and a bottom semiconductor substrate 44, and including a gap therebetween, such as an air gap. The various components and parameters of the circuit 40 would also be designed for a specific application as discussed above for the circuit 10 as shown in FIG. 1. The substrate 42 is shown as being transparent in this view solely for the purposes of clarity in that the substrate 42 is a semiconductor substrate that may or may not be transparent. The circuit 40 includes a first Archimedean spiral delay line 46 formed on a top surface 48 of the top substrate 42 and having an input/output port 50 and a center port 52. A planar metal layer 54 is deposited on a bottom surface of the top substrate 42 and includes a center hole 56 formed therethrough. A second Archimedean spiral delay line 58 is formed on a top surface 60 of the bottom substrate 44 and has an input/output port 62 and a center port 64. A conductive line 66, such as an inter-cavity interconnection (ICIC), is electrically connected to the delay line 46 at the port 52 and the delay line 58 at the port 64 and extends through the opening 56, so the line 46 and the line 58 are electrically isolated by the metal layer 54.

In this configuration, the metal layer 54 provides magnetic isolation between the delay lines 46 and 58 to provide an ultra-wideband delay structure. The length of the delay defined by the circuit 40 is provided by a combination of the lengths of the lines 46 and 58. Thus, the combination of the delay lines 46 and 58 being connected by the line 64 is a single delay line that is compact by the Archimedean spiral configuration, where the metal layer 54 provides magnetic isolation and prevents signal cross-talk between the lines 46 and 58 as the signal propagates from the port 50 to the port 60 with reduced backward/forward coupling effects and suppressed radiation.

Figure 3:
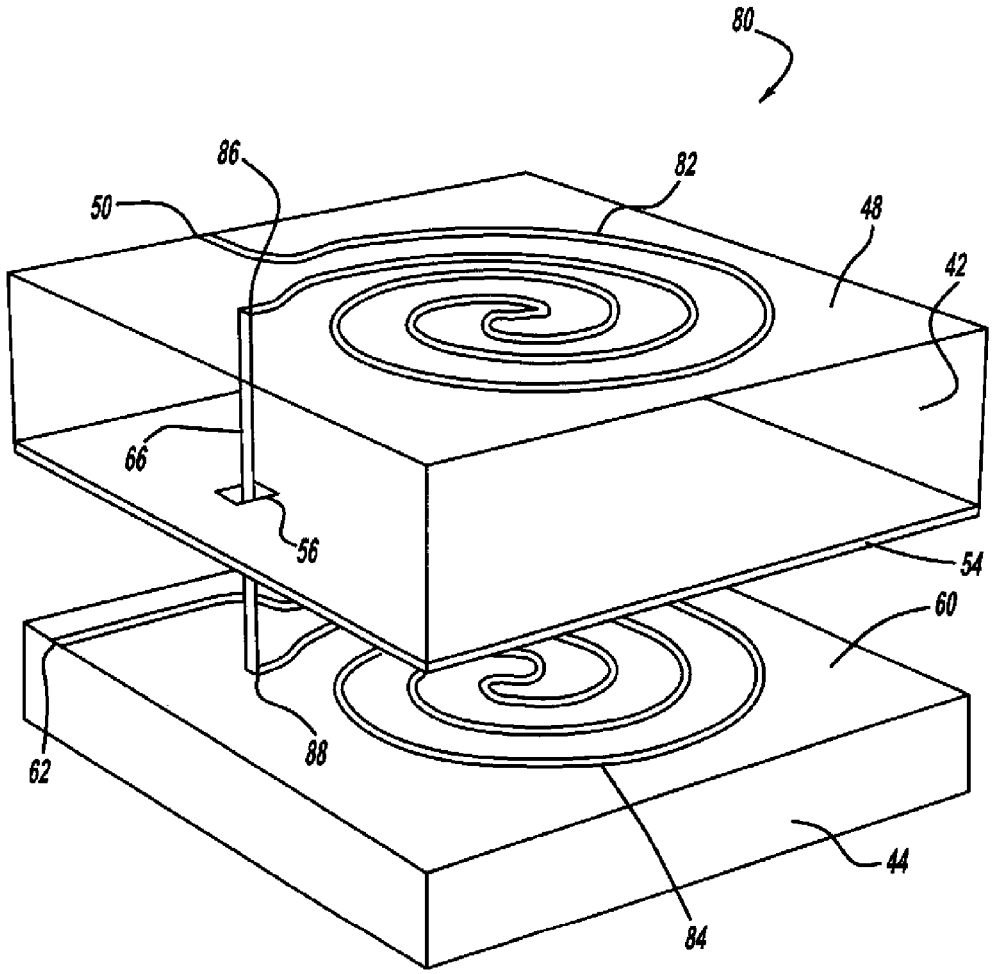
FIG. 3 is a perspective view of another TTD line circuit including a first Archimedean spiral on one substrate and a second Archimedean spiral on an adjacent substrate.

FIG. 3 is a perspective view of a TTD line MMIC 80 similar to the TTD line MMIC 40 shown in FIG. 2, where like elements are identified by the same reference number and may not be all described in detail herein. In this embodiment, the first and second Archimedean spiral delay lines 46 and 58 of FIG. 2 are replaced with Archimedean spiral delay lines 82 and 84 of FIG. 3, respectively, that wind towards the center of the substrates 42 and 44, respectively, and then back towards an edge of the substrates 42 and 44, respectively, to end at ports 86 and 88, respectively. Because the length of the lines 82 and 84 have been increased, the delay provided by the MMIC 80 is also increased relative to the MMIC 40 of FIG. 2. The conductive line 66 electrically couples the ports 86 and 88 in the same manner.

Figure 4:
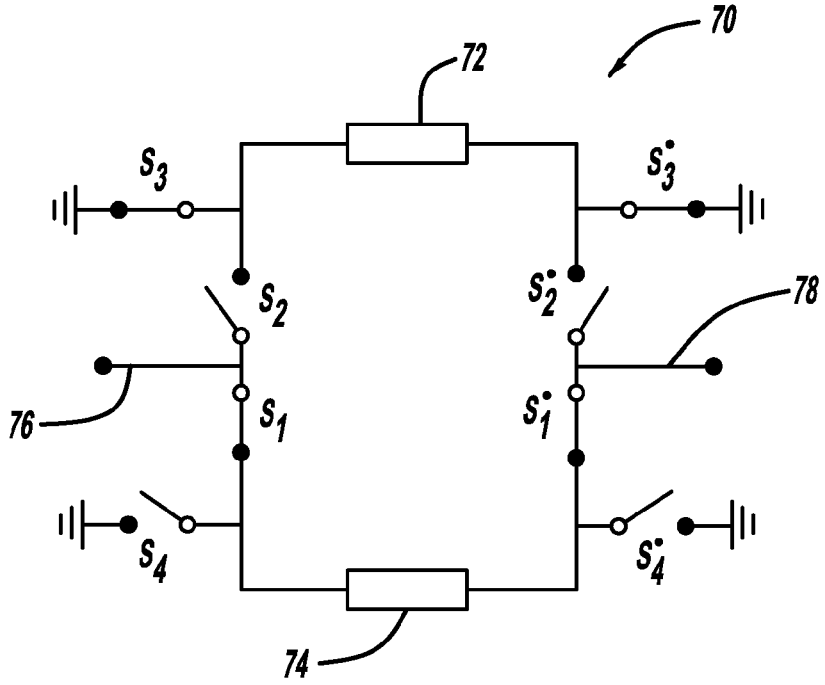
FIG - 4 Prior Art
FIG. 4 is a schematic diagram of a known single-bit switched TTD line circuit.

FIG. 4 is a schematic diagram of a single-bit switched TTD line circuit 70 of the type known to those skilled in the art. The circuit 70 includes a delay path 72 and a reference path 74 that provides a zero reference delay. A signal at input port 76 travels to output port 78, and depending on which path 72 or 74 the signal travels through, a difference in the delay time is generated. Switches $S_1$, $S_2$, $S_3$, and $S_4$ and complementary switches $S'_1$, $S'_2$, $S'_3$ and $S'_4$ are switched in association with each other to direct the signal along either of the paths 72 or 74. The circuit 70 is a single-bit switched TTD line. However, multi-bit switched TTD lines based on the same principle are well known to those skilled in the art.

Figure 5:
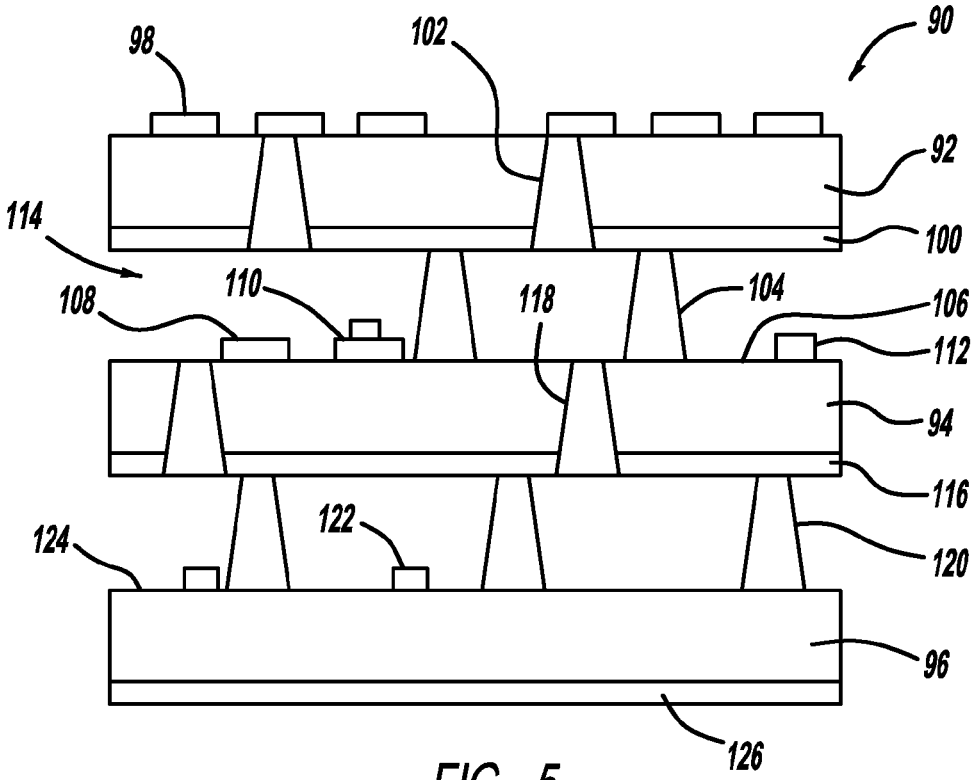
FIG. 5 is a cross-sectional view of a multi-bit switched TTD line circuit provided on multiple wafers.

FIG. 5 is cross-sectional view of a multi-bit switched TTD line MMIC 90 including a top wafer 92, a middle wafer 94 and a bottom wafer 96 that are spaced apart. The top wafer 92 includes an Archimedean spiral TTD line 98 that is the same or similar to the delay line 14 discussed and depicted in FIG. 1 above having the delay line sections 24 and 28. The top wafer 92 also includes a backside metal layer 100 and vias 102 extending through the wafer 92 and the backside metal layer 100, and then connecting to specific ports of the TTD line 98, such as ports similar to the ports 18, 20, 26 and 30 depicted in FIG. 1. The middle wafer 94 is spaced from the top layer 92 to form an air gap therebetween, where an inter-cavity interconnection (ICIC) 104 extends through the air gap and the metal layer 100 to connect to circuit components on a top surface 106 of the middle wafer 94. A plurality of circuit elements 108, 110 and 112 are fabricated on the top surface 106 of the middle wafer 94 and form a multi-bit switched circuit 114 of any suitable or known configuration, such as shown in FIG. 4, or other circuits known to those skilled in the art. The switched circuit 114 is electrically connected to the TTD line 98 at the proper location by the vias 104 and 102. The middle wafer 94 includes a backside metalized layer 116 and vias 118 extending therethrough that make electrical contact with ICIC 120 that extends through an air gap between the middle wafer 94 and the bottom wafer 96. Power components 122 are fabricated on a top surface 124 of the bottom wafer 96, and a metal layer 126 is provided on a backside surface of the wafer 96.

Each of the circuits 10, 40, 80 and 90 discussed above provide a number of advantages for true time delay lines over those known in the art. The monolithic design of the circuits 10 (FIG. 1), 40 (FIG. 2), 80 (FIGS. 3) and 90 (FIG. 5) provide ease of integration with other MMIC front end circuits with no complicated transitions. Significant reduction in radiation, cross-talk and forward/backward coupling is achieved by portioning the delay line into multiple sections on different layers. Further, the circuits 10, 40, 80 and 90 provide orders of magnitude tighter tolerance and delay lines due to the MMIC design and process, and provide a much smaller size due to the configuration. Further, the circuits 10, 40, 80 and 90 provide an optimization and design methodology for trade-off wafer/circuitry configurations with various electrical performance. The wafer level packaging (WLP) available with the MMIC designs of the circuits 10, 40, 80 and 90 provides hermetic operation from close to DC into the millimeter wavebands with unprecedented bandwidth.

The foregoing discussion discloses and describes merely exemplary embodiments. One skilled in the art will readily recognize from such discussion, and from the accompanying drawings and claims, that various changes, modifications and variations can be made therein without departing from the spirit and scope of the disclosure as defined in the following claims.

What is claimed is:

1. A time delay circuit comprising:

a first Archimedean spiral delay line having a first end and a second end;

a second Archimedean spiral delay line having a first end and a second end; and an electro-magnetic circuit isolation component positioned relative to the first and second Archimedean spiral delay lines and providing electric and/or magnetic isolation between the first and second Archimedean spiral delay lines.

2. The delay circuit according to claim 1 wherein the first and second Archimedean spiral delay lines are formed on a common surface of a first substrate and are concentric with each other.

3. The delay circuit according to claim 2 wherein the first and second Archimedean spiral delay lines combine to form a single delay line.

4. The delay circuit according to claim 2 wherein the first end of the first Archimedean spiral delay line is an input port and the first end of the second Archimedean spiral delay line is an output port where the second ends of the first and second Archimedean spiral delay lines are electrically coupled.

5. The delay circuit according to claim 4 wherein the second ends of the first and second Archimedean spiral delay lines are directly coupled.

6. The delay circuit according to claim 2 wherein the second ends of the first and second Archimedean spiral delay lines are coupled by circuit components.

7. The delay circuit according to claim 2 wherein the electro-magnetic circuit isolation component is a plurality of vias extending through the first substrate to an inter-cavity interconnection (ICIC) between the first and second Archimedean spiral delay lines, said plurality of vias being etched through a ground plane and then routed through the ICIC to a separate wafer.

8. The delay circuit according to claim 2 further comprising a second substrate spaced apart from the first substrate and including a multi-bit switched circuit formed on a surface of the second substrate.

9. The delay circuit according to claim 8 wherein an air gap is formed between the first and second substrates, said delay circuit further comprising one or more inter-cavity interconnections extending through the air gap and being electrically coupled to the multi-bit switched circuit through a ground plane associated with the first substrate.

10. The delay circuit according to claim 1 wherein the first Archimedean spiral delay line is formed on a top surface of a first substrate and the second Archimedean spiral delay line is formed on a top surface of a second substrate, said first and second substrates being spaced apart from each other, and said first and second Archimedean spiral delay lines being electrically coupled together by an inter-cavity interconnection.

11. The delay circuit according to claim 10 wherein the electro-magnetic circuit isolation component is a conductive plane formed on a bottom surface of the first substrate, said conductive plane including an opening through which the inter-cavity interconnection extends.

12. The delay circuit according to claim 10 wherein the first and second Archimedean spiral delay lines each terminate at a center location of the first and second substrates or at an outer location of the first and second substrates.

13. A time delay circuit comprising:

a first semiconductor substrate including a top surface and a bottom surface;

a first delay line formed on the top surface of the first substrate and having a first end and a second end;

a metal layer formed on the bottom surface of the first substrate and including an opening;

a second semiconductor substrate including a top surface and being spaced apart from the first substrate so as to provide an air gap therebetween;

a second delay line formed on the top surface of the second substrate and having a first end and a second end; and an inter-cavity interconnection electrically coupled to the second ends of the first and second delay lines and extending through the first substrate, the opening in the metal layer and the air gap between the first and second substrates.

14. The delay circuit according to claim 13 wherein the first and second delay lines are spiral delay lines.

15. The delay circuit according to claim 14 wherein the first spiral delay line spirals from an outer location of the first substrate to an inner location of the first substrate where the second end of the first delay line is approximate a center location of the first substrate and the second spiral delay line spirals from an outer location of the of the second substrate to an inner location of the second substrate where the second end of the second delay line is approximate a center location of the second substrate.

16. The delay circuit according to claim 14 wherein the first spiral delay line spirals from an outer location of the first substrate towards a center location of the first substrate and then back towards an outer edge of the first substrate where the second end of the first delay line is approximate the outer edge of the first substrate, and the second spiral delay line spirals from an outer location of the second substrate towards a center location of the second substrate and then back towards an outer edge of the second substrate where the second end of the second delay line is approximate the outer edge of the second substrate.

17. A time delay circuit comprising:

a first substrate including a top surface and a bottom surface;

a delay line formed on the top surface of the first substrate and including a first end and a second end;

a metal layer formed on the bottom surface of the first substrate;

a plurality of first vias extending through the first substrate and being electrically coupled to the delay line;

a second substrate including a top surface and a bottom surface, said second substrate being spaced apart from the first substrate and defining an air gap therebetween;

a multi-bit switched circuit formed on the top surface of the second substrate; and a plurality of inter-cavity interconnections electrically coupled to the multi-bit circuit and the metal layer on the bottom surface of the first substrate and extending through the air gap.

18. The delay circuit according to claim 17 wherein the delay line is a spiral delay line.

19. The delay circuit according to claim 18 wherein the delay line is formed by first and second delay line sections.

20. The delay circuit according to claim 19 further comprising a plurality of second vias extending through the first substrate between the first and second delay line sections and providing magnetic isolation between the first and second line sections.

* * * * *